US006397472B1

(12) United States Patent
Kayal

(10) Patent No.: US 6,397,472 B1
(45) Date of Patent: Jun. 4, 2002

(54) HAIR TRIMMING DEVICE FOR SELF USE

(76) Inventor: Bimal Kumar Kayal, C/o Industrial Equipments, Assam Trunk Road, 1st Floor, Opp Pan Bazar Flyover, Guwahati 781001 (Assam) (IN)

( * ) Notice: Subject to any disclaimer, the term of this patent is extended or adjusted under 35 U.S.C. 154(b) by 0 days.

(21) Appl. No.: 09/790,403

(22) Filed: Feb. 23, 2001

(51) Int. Cl.[7] ..... B26B 21/12
(52) U.S. Cl. ..... 30/30
(58) Field of Search ..... 30/30, 31, 223.5, 30/51, 53, 54, 55

(56) References Cited

U.S. PATENT DOCUMENTS

| | | | | | |
|---|---|---|---|---|---|
| 3,029,509 | A | * | 4/1962 | Peters | 30/30 |
| 3,613,233 | A | * | 10/1971 | Lundell | 30/30 |
| 3,711,948 | A | | 1/1973 | Ford et al. | 30/212 |
| 3,805,381 | A | | 4/1974 | Broussard, Sr. | 33/233.5 |
| 4,009,517 | A | | 3/1977 | Horn | 30/30 |
| 4,622,745 | A | | 11/1986 | Wahl | 30/201 |
| 4,709,475 | A | | 12/1987 | Phung | 30/31 |
| 4,845,852 | A | | 7/1989 | Sukow | 30/201 |
| 5,259,114 | A | | 11/1993 | Shorter | 30/131 |
| 5,386,750 | A | | 2/1995 | Morrison | 83/13 |
| 5,461,780 | A | | 10/1995 | Morana | 30/30 |
| 5,937,526 | A | | 8/1999 | Wahl et al. | 30/201 |

FOREIGN PATENT DOCUMENTS

| | | | | |
|---|---|---|---|---|
| FR | 627135 | * | 3/1927 | 30/30 |
| GB | 144149 | * | 6/1920 | 30/30 |
| GB | 148633 | * | 7/1920 | 30/30 |
| GB | 158594 | * | 2/1921 | 30/30 |
| GB | 164669 | * | 9/1921 | 30/30 |
| GB | 255946 | * | 7/1926 | 30/30 |
| GB | 343092 | * | 2/1931 | 30/30 |

* cited by examiner

*Primary Examiner*—Hwei-Sqiu Payer

(57) ABSTRACT

A simple, inexpensive yet highly versatile hair trimming device, particularly adapted for self use, comprises of a comb-frame (20), a blade-holder (22), and a detachable handle (24). The comb-frame having a comb portion with plurality of comb-teeth (32) flanked on either side by side-arms (26) has a rectangular horizontal through-hole (34) in its top portion to receive a shaft (46) of the detachable handle which may be temporarily fixed on any one of its two sides, right or left, thereby offering option of right-hand or left-hand use. The side-arms of the comb-frame have grooved tracks (28) to allow slidably mounting of the blade-holder. The blade-holder has a cutting blade (36) fixed on its inside surface. Balls (40), singularly fixed on each of the lateral-arms (44) of the blade-holder in a free-roll mode vide housing cups (42) allows the blade-holder to be slidably mounted on the comb-frame as well as oscillate a little thereon facilitating the cutting blade's adjustment in a transverse position in relation to the comb-frame in order to give smooth and efficient trimming operation. To secure such transverse alignment a position lock (38) is attached to the blade-holder vide tube (37), fixed on its outside surface, and hinges (39). Slidable adjustment of the blade-holder near or away from the edge of the comb-teeth ensure that hair may be cut to any desired length within a predetermined range.

10 Claims, 6 Drawing Sheets

HAIR TRIMMING DEVICE FOR SELF USE

BACKGROUND—Field of Invention

This invention relates generally to a hair trimming device particularly adapted for use in self—trimming.

BACKGROUND—Description of Prior Art

The art of hair cutting or trimming is as old as the human civilization. No wonder if a hair cut turns out to be the very first civilized action of mankind. Rapid and recurring growth of hair requiring regular cutting has caused significant development both in the field of the relevant art as well as production and designing of various tools and devices. Particular progress has been made in case of shaving appliances.

Various types of electric clippers and other automated tools as well as hand-manipulated devices have heretofore been developed for hair trimming. Most of these devices, however, suffer from one or more shortcomings, chief among which are their cumbersomeness, lack of maneuverability, tendency to pull the hair during cutting, comparatively complex construction which makes cleaning and maintenance difficult and lastly relatively high initial cost.

Comparatively simple, mechanical hair trimming devices, which are operable via a regular hair combing action, are known to the art. Such a device is found in U.S. Pat. No. 4,009,517. It describes a hair trimming tool wherein a blade holder is hinged to a comb in an operating position substantially parallel to the comb. The comb and the blade may be adjusted toward and away from each other by loosening and tightening screws. A finger piece is also provided on the holder so that the blade and the comb may be adjusted transversely to each other by light finger pressure. Though the device is simple it offers limited choice as regards cutting of hair to a desired length. Further, to ensure the desired transverse position of comb and blade, continuous finger pressure is necessary which at times become cumbersome. Also, since the handle is permanently fixed to one side of the device, use of device by both hands is not convenient.

Significantly complex compared to the one described above, another hair trimming apparatus is found in U.S. Pat. No. 4,622,745. This configuration, particularly adapted for trimming beards, moustaches and the like, includes a hair clipper having a fixed handle, one stationary and one moving blade, and one-piece adjustable comb attachment. The cutting blades of the clipper have corrugated teeth. The position of the comb attachment with respect to the blades is determined by placing any one of a plurality of indentations in the attachment over a protruding part of the clipper, such as one or more screw heads, which secures one or more of the blades to the clipper. This device has a permanently fixed handle and though it may be operated by either hand position of the handle is not always convenient for the user. Further, for change of position of the comb attachment in relation to the clipper, a tool is required to loosen or tighten screw(s) which process is a bit clumsy. Also, in a purely mechanical device effective utility of two blades, one oscillating and another stationary having corrugated teeth, is limited and doubtful.

Yet another hair trimming device is described in the U.S. Pat. No. 5,461,780. In this particular handle less device conventional razor blades are sandwiched between a base element and a mating backing element, both of which have one or more arrays of comb-like teeth and the backing element may be a comb per se. The base and back elements are disengagably adjustably secured together by a spring-loaded thumbscrew/cup nut configuration which allows blade replacement and user selection from multiple tooth array/blade edge combinations. As regards cutting of hair to a desired length this device offers multiple tooth array/blade edge combinations which in turn make different embodiments rather inconvenient in shape/size or cause to limit the choice of desirable length of hair cut. The device being handle less can be conveniently used by either hand but uniformity of desired length of hair cut is not ensured at all points. Also, blade edge/tooth array horizontal combination leaves scope for crevices which is not desirable.

SUMMARY

In accordance with the present invention a hair trimming device for self use comprises a comb-frame, a blade-holder and detachable handle(s) that may be attached to either side of said comb-frame.

Objects and Advantages

Accordingly, several objects and advantages of the present invention are:

a) To provide a simple, mechanical, cost effective hair trimming device for self use.

b) Another object is to provide a hair trim device which offers multiple choice to the user as regards its use on any part of human body, its operation by either hand as well as desired length of hair trimming.

c) Still another object is to provide a hair trimming device, which can be easily operated, and can give most satisfactory, quick, hassle free result.

d) Yet another object is to provide a hair trimming device which can be easily assembled or disassembled and which has minimum maintenance requirements.

Further objects and advantages are to provide a hair trimming device for self use which is safe, smooth and simple to operate, easy to manufacture and inexpensive. These and other objects and advantages of the present invention are discussed or will become apparent from a consideration of the ensuing detailed description and drawings.

DRAWING FIGURES

In the drawings, closely related figures have the same number but different alphabetic suffixes.

FIGS. 1A & 1A' shows front-surface view (i.e. surface away from skin while in use) and side view respectively of assembled unit with blade-edge in transverse position in relation to comb-frame.

FIGS. 1B & 1B' shows front-surface view and side-view respectively of assembled unit with unlocked blade-holder. Consequently, blade-edge is seen in parallel position in relation to comb-frame.

REFERENCE NUMERALS IN DRAWINGS

| | |
|---|---|
| 8 | Sliding range for blade - holder |
| 20 | comb-frame |
| 22 | blade-holder |
| 24 | detachable handle |
| 26 | side- arms of comb-frame |
| 28 | grooved track |
| 30 | stop |
| 32 | comb-teeth |
| 34 | horizontal through-hole |
| 36 | blade |
| 37 | tube |
| 38 | position lock |
| 39 | hinges |
| 40 | balls |
| 42 | housing cups |
| 44 | lateral-arms of blade-holder |
| 46 | shaft |
| 48 | air-pocket depressions |
| 50 | handgrip |
| 52 | clip |

DESCRIPTION

FIGS. 1A to 4B—Preferred Embodiment

Figure 1A:
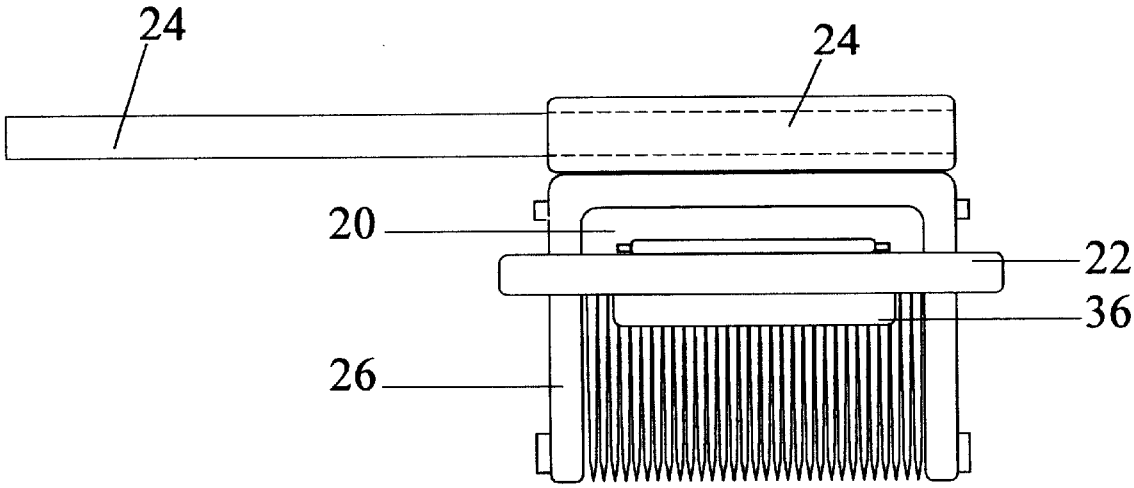
FIG. 1C shows back-surface view (i.e. surface close to skin while in use) of assembled unit.
Figure 1A:
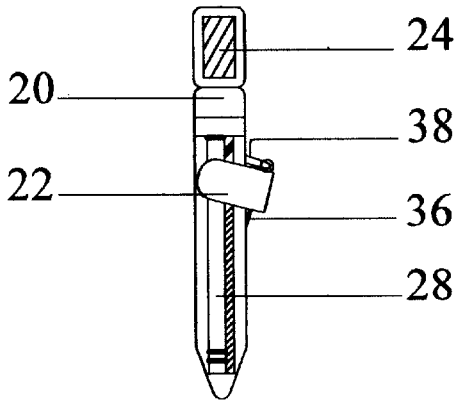

FIGS. 1A & 1A' depicts in an assembled state a preferred embodiment of hair trimming device of the present invention comprising a comb-frame 20, a blade-holder 22 and a detachable handle 24. Detachable handle 24 is temporarily fixed on one side of comb-frame 20. Blade-holder 22 is mounted on side-arms 26 of comb-frame 20 and placed in grooved tracks 28 on side-arms 26. Blade 36 fixed on the inside surface of blade-holder 22 is seen in a transverse position in relation to comb-frame 20 and secured in such state vide position lock 38.

Figure 1B:
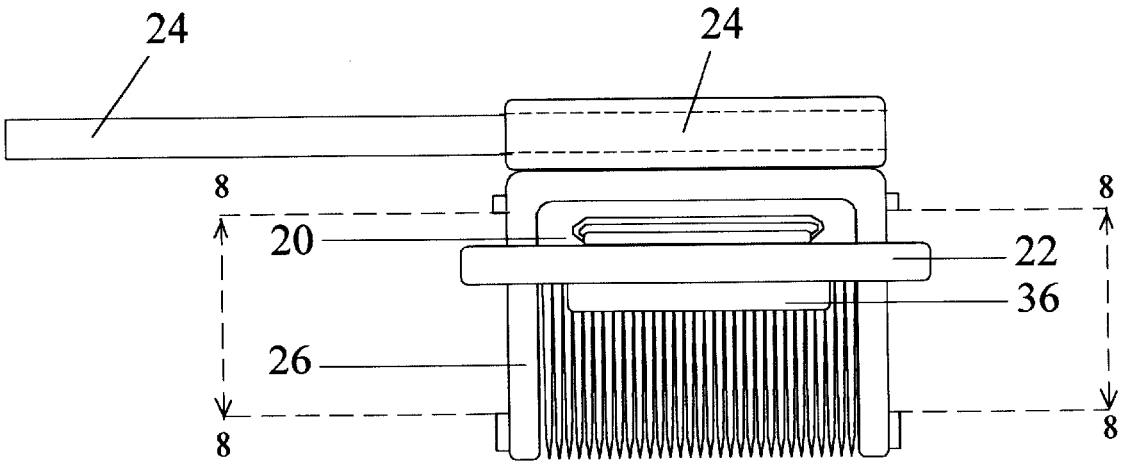
Figure 1B:
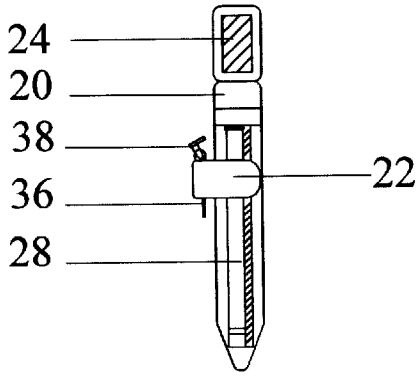

FIGS. 1B & 1B' shows said assembled unit with position lock 38 being released and accordingly blade 36 as well as blade-holder 22 in a parallel position in relation to comb-frame 20. Axis 8-8 indicate range of sliding movement of blade-holder 22 on side-arms 26 of comb-frame 20.

Figure 1C:
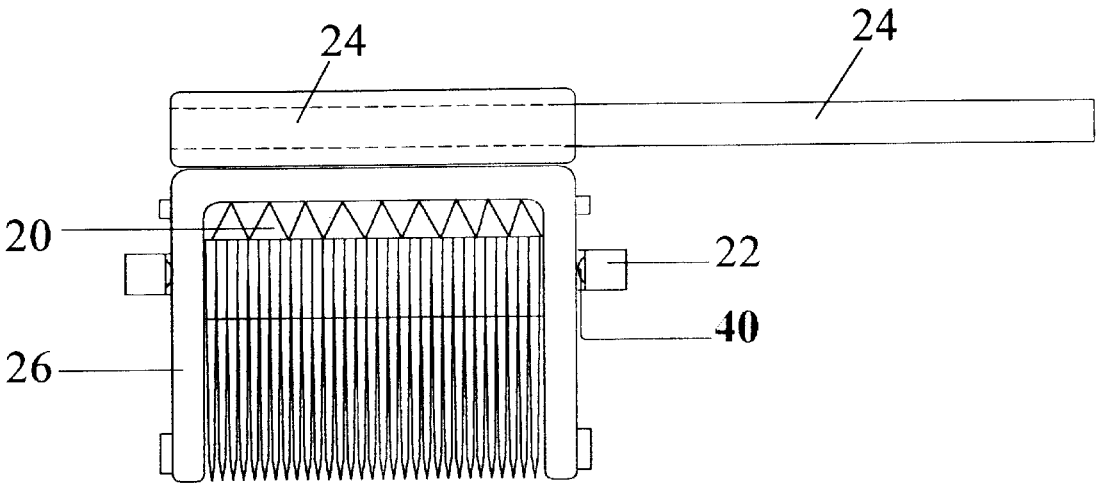

FIG. 1C shows the opposite, comparatively clear face of the assembled unit wherein blade-holder 22 is seen mounted on the other side of comb-frame 20 by means of solid steel balls 40 attached to blade-holder 22.

Figure 2A:
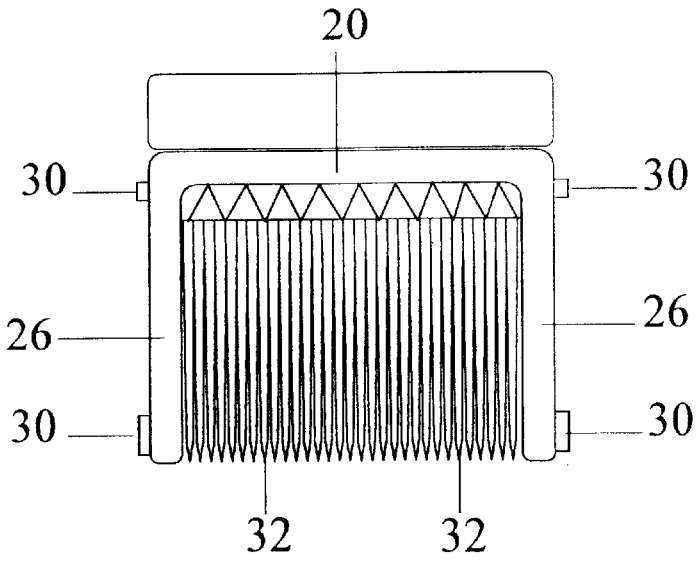
FIG. 2A shows front/back surface view of comb-frame.
Figure 2B:
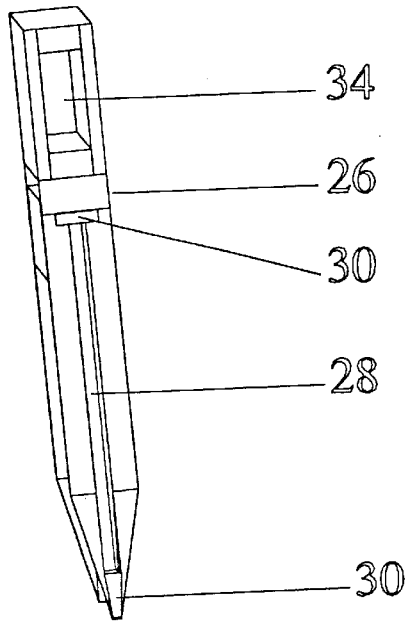
FIG. 2B shows perspective side view of comb-frame.

FIGS. 2A and/or 2B diagrammatically illustrate comb-frame 20 having a comb portion with plurality of equally spaced parallely arranged comb-teeth 32 of unitary construction flanked on either side by side-arms 26. Top portion of comb-frame 20 has a rectangular horizontal through-hole 34 to receive shaft 46 of detachable handle 24 which may be temporarily fixed on any one of the two sides of comb-frame 20 through-hole 34. Each of the two side-arms 26 of comb-frame 20 have longitudinal grooved tracks 28 closed on either ends via stops 30.

It is to be specifically noted that the horizontal straight-line distance between the outer surfaces of the two side-arms 26 of comb-frame 20 shall always measure slightly more compared to the tip to tip inside width measurement of balls 42 of blade-holder 22. So that, with application of little thumb pressure when mounted, blade-holder 22 acquires a firm grip over comb-frame 20.

Subject to what has been stated in the preceding paragraph, comb-teeth may vary by any or all of their spacing, length and/or cross-sectional dimension parameters, as well as width and depth of the spaces between the comb-teeth. Length of the comb-teeth is important as it determines as to how far from the surface one may pass the device through the hair to effect a cut.

Taking recourse to the process of molding or die-casting such comb-frame may be easily manufactured from any substantially rigid, unbreakable yet lightweight material such as PVC, or even metal like aluminum.

Figure 3A:
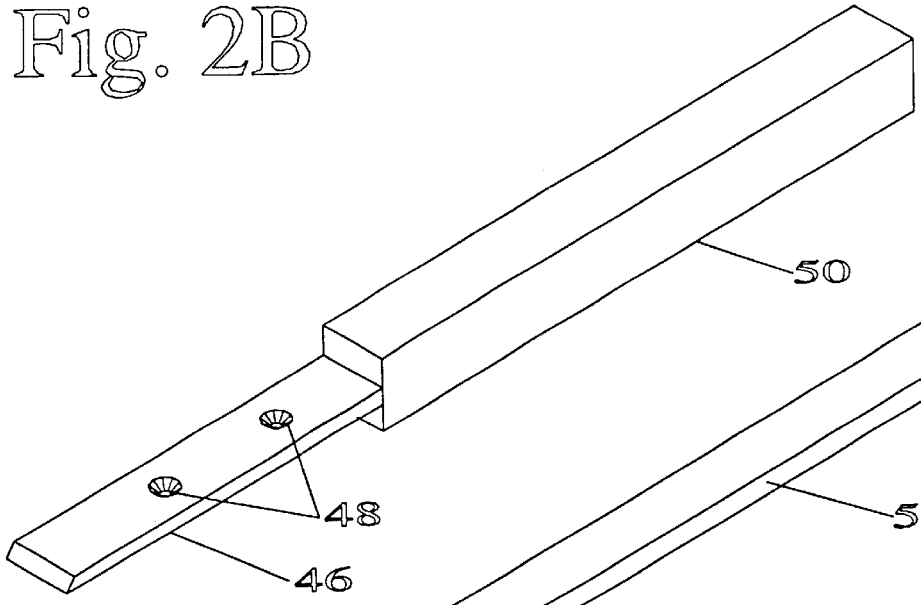
FIG. 3A shows perspective view of flat detachable handle.

FIG. 3A illustrates detachable handle 24 which is flat in shape and which consist of two parts viz. shaft 46 and handgrip 50. Handgrip 50 is thicker compared to shaft 46. Shape and size of shaft 46 allows its airtight fitting into the horizontal through-hole of comb-frame 20. Further, shaft 46 having round end-corners has more than one circular depressions 48 on either side of its surface, in order to create air-pockets when it is pushed inside through-hole 34 of comb-frame 20, so that the action of fixing or removing the handle 24 to/from said comb-frame 20 becomes smooth and easy.

Figure 3B:
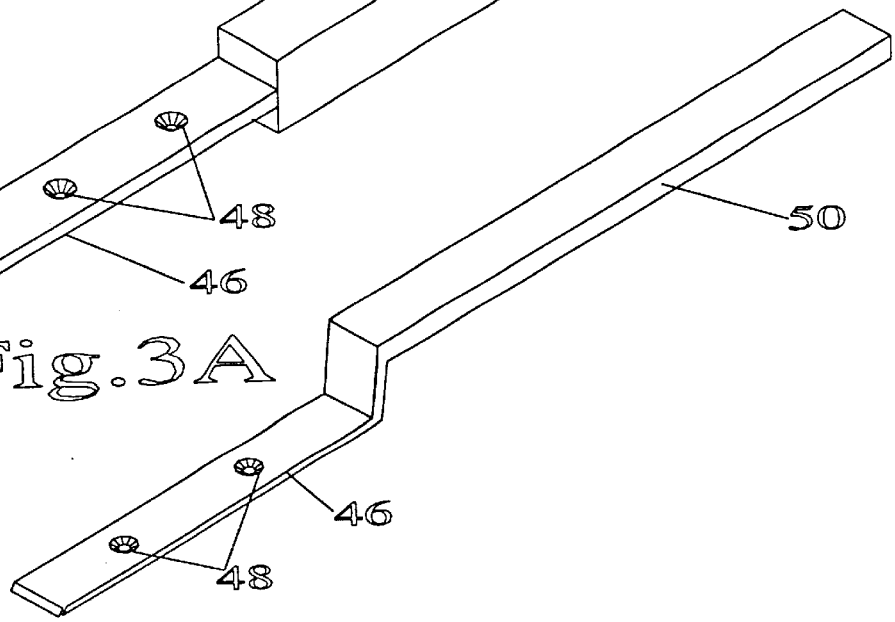
FIG. 3B shows perspective view of spoon-shaped detachable handle.

FIG. 3B illustrates an additional detachable handle which is more or less shaped like a spoon to facilitate easy or better operation of the hair trimming device on certain parts of human body, say armpits.

Such detachable handles can be easily molded or die-cast preferably from flexible and unbreakable plastic such as poly-ethylene-tere-phthalate (PET—hyphens here supplied to facilitate pronunciation) etc.

Figure 4A:
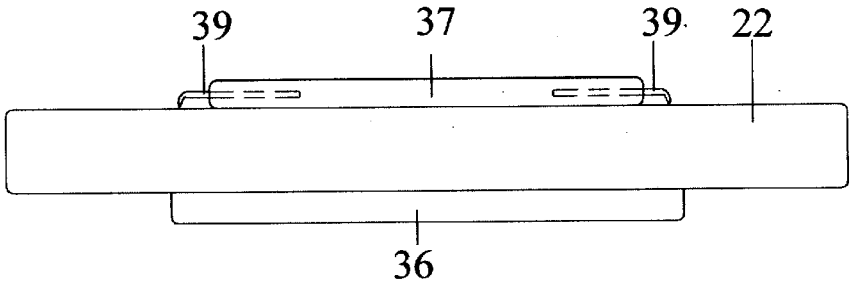
FIG. 4A shows outside-surface view of blade-holder.
Figure 4B:
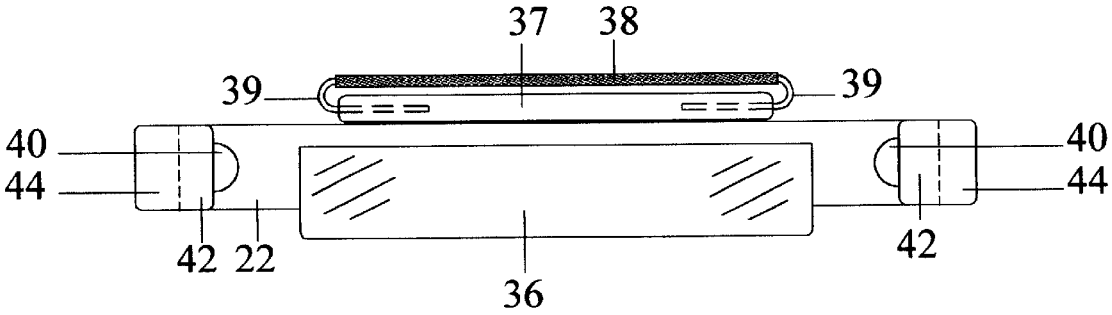
FIG. 4B shows inside-surface view of blade-holder.

As particularly seen in FIGS. 4A and 4B blade-holder 22 has a piece of cutting blade 36 which is firmly fixed (pasted) on its inside surface and may be additionally supported by pasting of a thin unbreakable plastic film over part of body portion (excluding however cutting edge) of blade 36 and exposed inside surface of blade-holder 22. Position lock 38, which is of a shape and size that it easily and appropriately fills the width of gap between the blade-holder and the comb-frame, is hinged to the blade-holder 22 on its outer surface through a tube 37 and hinges 39. Each of the lateral-arms 44 of blade-holder 22 has a single solid steel ball 40 attached in a free-roll mode to its inside surface vide housing cups 42.

As mentioned hereinbefore tip to tip inside width measurement of the two balls 40 of blade-holder 22 will always be slightly less compared to the width measurement between the outer surfaces of the two side-arms 26 of comb-frame 20.

In view of standardization of production such width measurement between the tips of the two balls 40 of blade-holder 22 is determinable considering various factors viz. width of the standardized blade to be used, allowance for the standardized thickness of the side-arms 26 of comb-frame 20.

Such housing cups, tube may be molded or die-cast along with body of blade-holder as one-piece from high quality rubber or flexible yet unbreakable plastic such as PET etc. Solid ball (s), made of high carbon steel (like one used in the manufacture of bicycles) or of any other appropriately rigid material like PVC, may be placed in the molded housing cup and then fixed by pasting of ring over the cup in such a manner so that it remains in a free-roll mode. Blade 36 may be manufactured from steel as in the case of various high quality normal shaving blades. Position lock 38 can also be manufactured from high quality rubber and hinges 39 thereof from lightweight metal-wire of appropriate specification.

Figure 5:
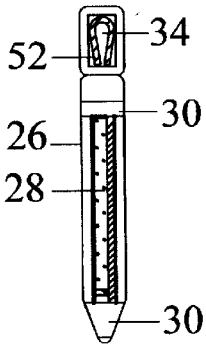
FIG. 5 shows side view of alternative comb-frame.
Figure 6:
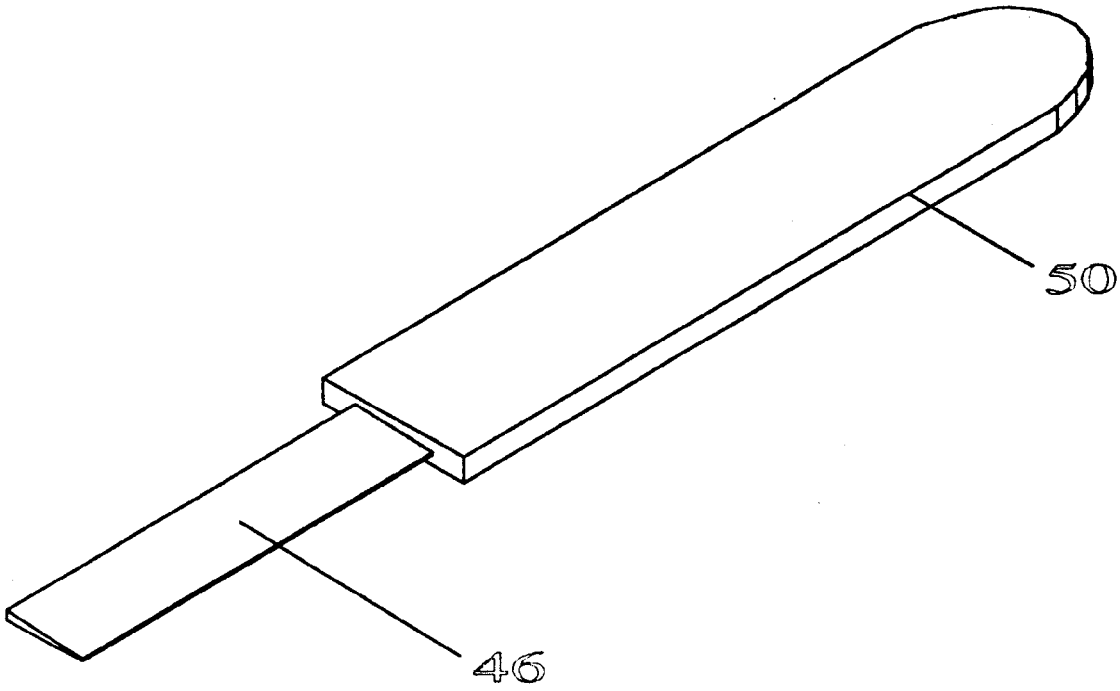
FIG. 6 shows perspective view of alternative detachable handle.

FIGS. 5 and 6—Alternative Embodiments

Various modifications in design of comb-frame as well as detachable handle(s) are contemplated and any types of inter-engaging fastening means for removably attaching handle to either side of comb-frame may be used. One such example is illustrated in FIG. 5 and FIG. 6. As illustrated in FIG. 5 horizontal through-hole 34 on top of comb-frame 20 has a clip 52, fixed inside, to conveniently receive shaft 46 of detachable handle. FIG. 6 shows a consequently designed detachable handle wherein shaft 46 is seen in an elongated oval shape and handgrip 50 is seen broader compared to shaft portion.

Further alternative embodiments within the scope of the present invention are also contemplated. For example, substituting for the detachable handle, top portion of comb-frame 20, instead of having a rectangular horizontal through-hole 34, may accommodate permanently fixed shafts of two alternative folding handles; one unfolding on the left side, and the other unfolding on the right side of the comb-frame 20. The handles themselves may have recesses to fit over the corresponding shafts. In yet another example of alternative embodiment within the scope of present invention, substituting for the detachable handle, top portion of comb-frame 20, instead of having a rectangular horizontal through-hole 34, may have one fixed frame having two parts; one part accommodating one handle which may slide out of the frame on the left side of comb-frame 20 and another part accommodating another handle which may slide out of the frame on the right side of comb-frame 20 respectively.

It is therefore to be understood that the invention is not limited in its application to the details of construction and the arrangement of components set forth in the description herein-contained or illustrated in the drawings. One of ordinary skill in the art may design different embodiments of the present invention. Further, the phraseology and terminology used herein is for the purpose of description and should not be regarded as limiting.

Operation—Assembly of hair trimming device

For operational purpose, one has to first assemble the hair trimming device of the present invention into a single unit. This may be easily done vide few steps which may be arranged in a manner in which the user may feel comfortable. No tool is required for assembly or disassembly of hair trimming device of the present invention.

For example, first step involves selection of the face of comb-frame 20 which will be away from skin while in use. In the next step, keeping in one hand the selected face of comb-frame 20 in front, blade holder 22 should be held in the other hand in a manner so that blade 36, protruding from inside, points to a downward direction and tube 37, position lock 38 and hinges 39 are visible on the outer surface of it. Then, one of balls 40 of blade-holder 22 should be placed in grooved track 28 on one matching side-arm 26 of comb-frame 20. Thereafter, the other ball 40 of blade-holder 22 should be placed inside grooved track 28 on the corresponding other side-arm 26 of comb-frame 20 by applying light thumb pressure.

As tip to tip inside width measurement of balls 40 is less compared to the width measurement between the outer surfaces of the grooved track 28 of comb-frame 20, blade-holder 22 now has a firm grip over comb-frame 20. Simultaneously, because housing cups 42 and so as balls 40 are fixed slightly away from the lower surface of blade-holder 22, blade-holder 22 has acquired the capacity of limited oscillatory movement along the axis formed by balls 40. Further, keeping the edge of blade 36 in horizontally parallel position in relation to comb-frame 20, by application of mild force, blade-holder 22 can be smoothly slided up or down the grooved-track 28 on side-arms 26 of comb-frame 20 by virtue of friction-less free-roll mode of balls 40. Sliding movement of blade-holder 22 in such fashion will ensure that neither the cutting edge of blade 36 nor comb-teeth 32 are in any manner damaged. Closed ends of grooved tracks 28 by means of stops 30 also ensure that blade-holder 22 does not accidentally slide off the comb-frame 20.

When blade 36 is transversely adjusted in relation to comb-frame 20 nearest the edge of comb-teeth 32, in use, hair cut will be closest to the skin of the user. As much blade 36 is slidably adjusted away from the edge of comb-teeth 32, and then brought in transverse position in relation to comb-frame 20, in use, hair cut will be so much or more away from the user's skin.

Keeping in mind the above facts as well as as the desired length of haircut, in the next step, blade-holder 22 should be slidably adjusted to a desired place on side-arms 26 of comb-frame 20. Next, blade-holder 22 is to be oscillated to a transverse position in relation to comb-frame 20 in such a manner so that the cutting edge of blade 36 comes firmly in contact with comb-teeth 32. Thereafter, position lock 38 should be secured between the gap created between comb-frame 20 and blade-holder 22 thereby restricting oscillatory motion of blade-holder 22.

Considering convenience of use with right hand or left hand, next step(s) involve fixing and/or refixing detachable handle 24 either to the right side or to the left side of comb-frame 20 by pushing shaft 46 inside horizontal through-hole 34 of comb-frame 20. Air-pocket depressions 48 on surfaces of shaft 46 will ensure smooth attachment or detachment function.

Operation—Use Hair Trimming Device

Hair trimming device of the present invention is easily operable by a typical combing motion. In use, keeping the relatively clear face of comb-frame 20 close (facing) to skin, comb-teeth are inserted into the hair to be cut. The device is drawn through the hair. During the stroke, the device may be slightly tilted and hair may be "sliced" at an angle to its length to produce a desired "style" cut. The user may draw the device repeatedly through the hair to get the desired result.

Comb-teeth 32 constitute the guides to not only appropriately channel the hair for presentation to the cutting edge of blade 36 without significant skipping or missing some of the hair and/or jamming or pulling the hair, but also maintain blade 36 at relatively fixed distance from the skin so that a uniform cut is accomplished. Proper safety from the danger of the sharp blade edge damaging the skin is provided by the fact that the actual blade edge is exposed only above and between the comb-teeth and nothing as large or larger in cross-section than the spacing between the comb-teeth 32 may come in contact with the edge of blade 36. Slidably adjusted blade-holder 22 and consequent transverse position of blade 36 in relation to comb-frame 20, near or away from the edge of comb-teeth 32 ensure that hair is effectively and uniformly cut to a predetermined desired length.

Usually, hair grows at an angle with respect to skin and generally tends to lie in a particular direction. Hair may be trimmed in the direction of hair growth, or with the lie of hair. It may also be trimmed in the direction opposite to the direction of hair growth or against the lie of hair.

Facial hair is preferably trimmed with the lie, to cut unruly hair which curl away from the main growth of a beard or moustache, and to cut excessively long hair, while at the same time leaving the appearance of a full growth of hair in the beard or moustache. Likewise, hair in the eyebrow is trimmed to give it good-looking uniform shape.

Hair trimming device of the present invention is light in weight, and of a size, shape and construction such that with the easy left or right attachment of the handle to the comb-frame as may be necessary, it may be advanced through the hair in a cutting stroke in any direction viz., vertically downward or upward, horizontally left to right or right to left, diagonally etc., thereby allowing the user to derive maximum satisfying results. No crevices being presented as the device is advanced through one's hair in a cutting stroke, any likelihood of catching the user's hair is avoided. Thus, a smooth and hassle-free hair trimming exercise is performed with ease.

The whole operation of hair trimming including assembly and disassembly of device and intermittent cleaning of comb-frame and blade edge can be satisfactorily accomplished within a reasonably short time.

Advantages

From the description above, a number of advantages of my hair trimming device become evident:

(a) It is simple and cost-effective. It can be easily assembled or disassembled and adjustments can be carried out—foregoing necessity of any tool.

(b) It is ideal for self use. Though however, it can be used with equal efficiency for the purpose of trimming of hair of other person or persons.

(c) It allows easy cleaning and sanitizing of the device after each use. It has minimum maintenance requirements. Blade-holders of the device can be easily replaced when necessary.

(d) It allows multiple choice to the user as regards its use on different parts or areas of human body.

(e) It offers a wide predetermined range for uniform trimming of hair to any desired length, within such range, in accordance with the user's choice.

(f) A user of the device can operate it with either hand with similar ease.

(g) During use, with the help of a mirror or otherwise, it allows the user to "feel" its operation and efficiency thereof and take recourse to adjustments, if necessary.

(h) It gives most satisfactory, quick, hassle free result.

CONCLUSION, RAMIFICATIONS AND SCOPE

Accordingly, there has been described a lightweight, highly versatile, yet simple and inexpensive hair trimming device for self use which can be manufactured from readily available, low cost materials with standard equipment. Furthermore, the hair trimming device of the present invention has the additional advantages in that

- it permits the production of hair trimming devices in a variety of colors;
- it permits the production of hair trimming des wherein comb-frame, detachable handle(s), and blade-holder(s) may be made of different colors for presentation of pleasant color-combinations;
- it allows the production of hair trimming devices wherein comb-frame (on the top portion as well as on comb-teeth) has sufficient surface space upon which printing of images, cartoons, pictures etc and/or printing of letters can be easily accomplished;
- it allows the production of hair trimming devices wherein at least one side-surface on top of comb-frame as well as the handgrip portion of detachable handle(s) may be given various exotic shapes or designs;
- it allows the production of hair trimming devices which can be efficiently used for trimming of hair from the body of household pets.

Although the above description contains many specificities, these should not be construed as limiting the scope of the invention but as merely providing illustrations of some of the presently preferred embodiments of this invention. For example, comb-frame of the hair trimming device may be manufactured from metal like aluminum etc. and, body portion of blade may have greater thickness and broader cutting edge so that the device can be conveniently used for trimming hair for commercial purpose from the body of animals e.g., sheep, goat etc.

Thus the scope of the invention should be determined by the appended claims and their legal equivalent rather than by the examples given.

I claim:

1. A hair trimming device, comprising (a) a comb-frame, having a comb portion with a plurality of parallely arranged comb-teeth flanked on either side by two side-arms, earth of the two side-arms having a closed end longitudinal grooved track, (b) means on a top portion of said comb-frame for receiving a handle, (c) at least one matching handle, (d) a blade-holder having a cutting blade fixed on its lower inside surface and first means on its upper-outside surface for fixing locking means for restricting oscillatory motion of the blade-holder; and second means on the inside surface of each of its two lateral arms for fixing a single hall apiece, in a free-roll mode, for mounting of the blade-holder on the two side-arms of said comb frame and simultaneously allowing it to slide up and down the comb-frame, whereby no tool is required for assembly or disassembly of the device or for carrying out adjustments thereof, and whereby hair may be cut to any length within a predetermined range, and whereby the device can be easily operated by right hand or by left hand, and whereby the device can be self-operated with ease on any desirable surface of human body.

2. A device according to claim 1, wherein said means on the top portion of said comb-frame comprises a through-hole to receive a shaft of said matching handle.

3. A device according to claim 2 wherein said shaft has a plurality of depressions on its surface(s) and the matching handle has a handgrip, which is thicker, compared to the shaft.

4. A device according to claim 2 wherein said through-hole has a clip fixed inside it.

5. A device according to claim 4 wherein the matching handle has an elongated oval shaped shaft having less width and thickness compared to its handgrip.

6. A device according to claim 1 wherein said cutting blade is made of high quality thin metal-strip.

7. A device according to claim 1 wherein said first means on the upper-outside surface of said blade-holder comprises a tube.

8. A device according to claim 7 wherein said locking means comprises hinges and a lock member.

9. A device according to claim 1 wherein said second means on the inside surface of the lateral arms of said blade-holder comprises housing cups.

10. A device according to claim 1 wherein another matching handle having an elevated handgrip compared to its shaft is additionally provided.

* * * * *

UNITED STATES PATENT AND TRADEMARK OFFICE

CERTIFICATE OF CORRECTION

PATENT NO. : 6,397,472 B1
DATED : June 4, 2002
INVENTOR(S) : Bimal Kumar Kayal

It is certified that error appears in the above-identified patent and that said Letters Patent is hereby corrected as shown below:

Column 2,
Line 24, change “trim” to -- trimming --.

Column 3,
Line 51, after reference numeral 20 and before the word through-hole insert -- via --.
Line 58, change reference numeral “42” to -- 40 --.

Column 7,
Line 45, change “des” to -- devices --.

Column 8,
Line 14, change “earth” to -- each --.
Line 25, change “hall” to -- ball --.

Signed and Sealed this

Twelfth Day of November, 2002

*Attest:*

*Attesting Officer*

JAMES E. ROGAN
*Director of the United States Patent and Trademark Office*